United States Patent [19]

Takao

[11] Patent Number: 4,554,107

[45] Date of Patent: Nov. 19, 1985

[54] REFINED FISH OILS AND THE PROCESS FOR PRODUCTION THEREOF

[75] Inventor: Masayasu Takao, Chiba, Japan

[73] Assignees: Q.P. Corporation; Nitto Hogei Co., Ltd., both of Japan; a part interest

[21] Appl. No.: 626,114

[22] Filed: Jun. 29, 1984

[30] Foreign Application Priority Data

Jul. 18, 1983 [JP] Japan ..... 58-130602

[51] Int. Cl.[4] ..... C11B 3/00; C11B 3/02; C11B 3/12

[52] U.S. Cl. ..... 260/421; 260/420; 260/428

[58] Field of Search ..... 260/420, 421, 428

[56] References Cited

U.S. PATENT DOCUMENTS

| | | | |
|---|---|---|---|
| 1,419,109 | 6/1922 | Bolton et al. | 260/421 |
| 1,925,559 | 9/1933 | Hickman | 260/428 |
| 2,126,466 | 8/1938 | Hickman | 260/428 |
| 2,136,774 | 11/1938 | Hickman | 260/428 |
| 2,258,671 | 10/1941 | Buxton | 260/420 |
| 2,759,883 | 8/1956 | Thurman | 260/428 |
| 3,697,387 | 10/1972 | Munch | 260/420 |

FOREIGN PATENT DOCUMENTS

| | | | |
|---|---|---|---|
| 151426 | 5/1953 | Australia | 260/420 |
| 17454 | 6/1913 | Denmark | 260/420 |
| 28506 | 3/1977 | Japan | 260/421 |
| 143321 | 5/1920 | United Kingdom | 260/421 |

*Primary Examiner*—J. E. Evans

*Attorney, Agent, or Firm*—Jacbos & Jacobs

[57] ABSTRACT

A substantially odorless, refined fish oil product containing more than 20% eicosapentaenoic acid as the fatty acid residue is provided. The product is produced by a process comprising combinations of steps of winterization of the oil, interesterification of the oil, deodorization procedure of the oil by heating thereof in vacuo with polyhydric alcohol and monoglyceride, and molecular distillation after the deodorization procedure. The product can be used mainly for prevention and therapy of thrombotic maladies by controlling the content of cholesterol in blood in humans.

12 Claims, No Drawings

REFINED FISH OILS AND THE PROCESS FOR PRODUCTION THEREOF

BACKGROUND OF THE INVENTION

Eicosapentaenoic acid (hereinafter abbreviated as "EPA") has been known to be effective in prevention and therapy of thrombotic maladies as it properly controls the content of cholesterol in blood in a living body and has an effect to prevent thrombotic disturbances.

The fish oils containing EPA can be obtained as by-products in producing such products as low-fat fish meal and fish cakes in oil expression by the method such as boiling or expressing method, from such fish as sardine and/or pilchard, chub mackerel, pacific saury, alaska pollack, etc. Thus the oil-expressing method employed in obtaining fish oils is quite rude in itself, and it commonly invites lowering of freshness of the material before oil-expression and, furthermore, formation of low-molecular amines through decomposition of proteinaceous materials in the fish meal in oil-expressing so that mingling of the amines in the fish oil cannot be avoided. On the other hand, fish oil contains a large amount of highly unsaturated fatty acids in addition to EPA, and these highly unsaturated fatty acids are oxidatively decomposed during the storage, which unavoidably form low molecular acids and/or low molecular ketones or aldehydes. Therefore, even though the fish oil freshly expressed from fresh materials has no perceptible odor, the low molecular amines contained in the fish oil is reacted, with the lapse of time, with the low molecular ketones and/or aldehydes that are formed during the storage and thereby odorous substances are formed, which give forth a nasty smell and cause lowering of the commercial value of said fish oil.

In order to prevent emission of such fish-oil-odors, they have conventionally employed the methods to subject fish oil expressed to refining treatments such as deacidification, deodorization and the like to remove impurities therefrom.

However, if these conventional refining methods could remove the odorous substances, it was still impossible to remove completely amines and/or ketones, the precursors of the odorous substances. Thus even though the refined fish oil obtained thereby has no odors right after the refinement, fishy odors come to be emitted with the lapse of time, as the odorous substances are formed. And there is a tendency that emission of fishy odor becomes more remarkable as the refined fish oil contains more higher content of highly unsaturated fatty acids such as EPA and the like. Therefore, no fish oils having higher concentration of EPA, although being odorless after a lengthy period of storage are available till to now.

DESCRIPTION OF THE INVENTION

The present invention relates to refined fish oils and the process for production thereof. The object of said invention is in providing novel refined fish oils containing a high concentration of eicosapentaenoic acid (carbon number 20, number of unsaturated double bonds 5) as the fatty acid residue, and almost free of fishy odor and in providing a method of producing thereof.

The inventor of the present invention, as the results of various researches for providing refined fish oils containing a high concentration of EPA and free of fishy odors and the process for production of such fish oils, took a hint in the fact that salad oils obtained from vegetable seeds, that are composed of almost pure triglyceride, do not give forth any bad smell even after a long period of storage, and discovered that even in case of fish oils, if they are subjected to molecular distillation after a definite pretreatment, refined fish oils as odorless as salad oils could be obtained; and based on the discovery, he accomplished the present invention.

The refined fish oil of the present invention contains more than 20% EPA as the fatty acid residue and is almost free of fishy odorous substances; and the process for production thereof is characterized in adding polyhydric alcohol and monoglyderide to a fish oil or winterized fish oil or interesterified fish oil, heating it in vacuo to remove the odor, then subjecting it further to molecular distillation and collecting the vaporized constituents as the refined oil.

The fish oils to be used as the starting materials in the present invention include not only the fat and oils obtained from such fish as sardine and/or pilchard, chub mackerel, pacific saury and the like, expressed according to a conventional method, but the fat and oils removed from viscera of pollack, shark, etc. and also from such Mollusca as squid and/or cuttle fish, octopus, etc.

The fish oil used as the starting material in the present invention may be crude fish oil expressed from fish, but in order to improve the efficiency of deodorization and molecular distillation that are to be operated in the later stages, it is desirable that the crude fish oil is subjected to acid refinement by means of phosphoric acid, sulfuric acid and the like, or to alkali treatment by means of caustic alkali, then further to the preliminary refinement such as deacidification, decoloration, dewaxing, etc. to obtain the product having higher content of triglycerides. Particularly for maintaining a transparent liquid state that does not cloud at normal temperature, it is effective to subject the fish oil to winterization for dewaxing.

In subjecting fish oil to winterization, any conventional method can be employed, but for effectively removing the solid fat contained in the fish oil, it is desirable to divide the winterization into two stages; the first winterization for dewaxing at a temperature of from 5° to −2° C. and then the second winterization at from −2° to −10° C. for further dewaxing. The object of winterization is to remove the solid glyceride having a boiling point almost the same as that of the liquid triglyceride contained in the fish oil so as to obtain a refined fish oil of high EPA content in the molecular distillation that is to be performed thereafter.

In the process for producing refined fish oils containing high content of EPA, there is a procedure other than the above winterization procedure, namely the procedure in which the fish oil is added with a catalyst such as sodium alcoholate to cause ester interchange reaction in the presence of an inert gas to obtain an interesterified fish oil. As an example for the procedure of interesterification reaction, a fish oil having acid value of less than 0.5% and moisture content of less than 0.2% by weight is added with 0.02–0.5% by weight of sodium alcoholate, the mixture is stirred under nitrogen gas at a temperature of 5°–30° C. to be reacted, and when the cloud point of the reaction mixture rises 7°–25° C. higher than that of the fish oil (the starting material), an acid such as phosphoric acid as a neutralizer in an amount corresponding to the neutralization equivalent is added for terminating the reaction to obtain an interesterified oil. Although the reaction times vary with the sorts of fish oils or reaction temperatures, they may be within the range of 3–36 hours. The reason for carrying out the interesterification reaction is in that the major portion of glycerides in the fish oil is converted to saturated triglycerides, thereby the glycerides can be recovered in higher yields by means of molecular distillation at the later stage.

According to the present invention, polyhydric alcohol and monoglyceride are first added to the fish oil or winterized fish oil or interesterified fish oil. As for said polyhydric alcohol, there is no particular restriction only if it is non-toxic, but it is recommendable to use glycerol or a divalent or trivalent alcohol such as dipropylene glycol. It is particularly preferable to use glycerol that has been generally accepted as the additive for foodstuff. The object of use of polyhydric alcohol in the present invention is that amines contained in fish oils have a strong hydration property, and therefore, when polyhydric alcohol that has a boiling point near that of amines is added to the fish oil, it imparts affinity to said amines for the hydroxyl groups of polyhydric alcohol and accelerates distillation and removal of amines caused by the distilling function of polyhydric alcohol in the following deodorization stage so that the amines are removed from the fish oil. And since polyhydric alcohol is insoluble in fish oil, it is impossible to disperse it homegeneously in the fish oil if said polyhydric alcohol is added thereto as it is. Then, according to the present invention, monoglyceride that is mutually soluble with polyhydric alcohol is added in the fish oil together with polyhydric alcohol, and by using it as a medium, it tried to disperse polyhydric alcohol homogeneously in the fish oil. As the monoglyceride, there are mono-oleyl glycerides and the like that are obtained from such vegetable oils as soybean oil and coconut oil and/or palm oil. And they can be used regardless of the type if one hydroxyl group of glycerol is ester-bonded with a fatty acid. As the monoglyceride, the crude material separated from fat and oil can be used, but it is more desirable to use distillated monoglyceride because said distillated monoglycerides are odorless. To add to, since said monoglyceride has a boiling point near that of cholesterol, it also acts the role of removing cholesterol, effectively from the fish oil in the following step of molecular distillation. The amount of addition of polyhydric alcohol and monoglyceride is respectively about 1–20 parts relative to 100 parts of fish oil, and when stirred and mixed at normal temperature or at the temperature lower than 50° C., a transparent mixed oil can be obtained.

In the next place, the mixed oil is heated in vacuo for deodorization. For deodorization, a continuous falling-film type deodorizing apparatus or a centrifugal molecular distillation apparatus is used, and volatile odorous constituents are removed by heating the fish oil in vacuo. As to the relation between the degree of vacuum and the oil-heating condition, they are: degree of vacuum, 10–100 mmTorr; temperature, 90°–150° C., respectively, and in this case, it is desirable to set the charging rate of the fat and oil at 20–150 kg/h/m$^2$. To add to, in deodorization, it is desirable to finish deodorization in as short a period as possible for preventing deterioration of highly unsaturated fatty acids such as EPA and the like in the fish oil.

Since the volatile odorous constituents such as amines, aldehydes, ketones, organic acids, etc. contained in the fish oil are removed by this deodorizing process, the deodorized fish oil, almost free of fishy odor, can be obtained in the yield of 90–98% relative to the fish oil, the starting material. Furthermore, in deodorization, polyhydric alcohol, being affinitive for amines, is distilled off, and accompanied therewith, removal of amines is accelerated so that the deodorized fish oil can be obtained in a short time, without deteriorating highly unsaturated fatty acids such as EPA, and the like.

According to the present invention, the deodorized fish oil thus obtained is further subjected to molecular distillation, and the volatilized constituents formed thereby are collected as the refined oil. For molecular distillation, the use of a centrifugal falling-film type distillation apparatus is desirable.

Though single operation of molecular distillation could satisfactorily produce the objective refined fish oil, the product containing a high concentration of EPA can be produced more efficiently when said molecular distillation is effected with the procedure divided into three stages.

To begin with, the first distillation is carried out on the deodorized fish oil at the degree of vacuum 5–30 mmTorr, film temperature at 100°–260° C. to distill off monoglyceride, fatty acid ester of cholesterol, etc. to obtain pure glyceride oil in the yield of 80–98% relative to 100 parts of the fish oil, the starting material. And by this first distillation, accompanied with monoglyceride, cholesterol is removed, and also the odorous substances remaining in a very little amount can completely be removed.

In the next place, the second distillation is performed on the pure glyceride oil obtained by the first distillation, at the degree of vacuum 0.1–50 mmTorr, film temperature 150°–300° C. to distill off the low molecular glyceride of molecular weight 800–880, having a low EPA content, and thereby high molecular glyceride is obtained in the yield of 35–65% relative to 100 parts of the fish oil. The film temperature exceeding 300° C. is undesirable because when it exceeds 300° C., EPA contained in the fish oil in the form of residue of ester causes pyrolytic reaction, which brings forth a tendency of forming ketones, a constituent of the precursors of fishy odor.

Finally, the third distillation is effected on the liquid glyceride obtained by the second distillation, at the degree of vacuum 0.1–30 mmTorr, film temperature 200°–300° C., and by cooling the volatilized constituents formed thereby and collecting them as the refined oil, the final refined oil containing more than 20% EPA can be obtained in the yield of 20–60% relative to 100 parts of the fish oil, the starting material. To add to, the protein that is contained slightly in the liquid glyceride and also nitrogen compounds, the decomposed products thereof, are left in the remnant oil as these have different boiling points from those of the volatilized constituents in the third distillation. The economic charging rate in the respective distillation stages are variant depending on the molecular distillation apparatuses to be used, but the rate 20–150 kg/m$^2$ per hour should be appropriate. The refined fish oil thus obtained was confirmed to have the EPA content of 20–30% in fatty acid residues.

According to the present invention, as we have so far set forth, the low molecular compounds and low molecular glycerides can be removed from fish oil by deodorization and through molecular distillation, and therefore, the material oil can be finished into a refined fish oil having a high EPA content. And if winterization or interesterification is performed as a pre-treatment, the starting oil material can be finished into a refined fish oil of much higher EPA content. Moreover, since amines have been distilled off by the action of polyhydric alcohol in said deodorization stage, and also since in the molecular distillation, there is no possibility of protein or nitrogeneous compounds, that is the decomposed products thereof, being mixed in the refined fish oil, a refined fish oil containing no precursor substances of fishy odor can be obtained thereby. Thus, according to the present invention, it is possible to produce a refined fish oil having a high content of EPA and emitting almost no fishy odor even in a long period of storage. The refined fish oils of the present invention are of high grade having content of glycerides more than 96% and content of cholesterol less than 0.1%.

EXAMPLE 1

A winter oil was obtained by using sardine oil having acid value 0.4, saponification value 191, iodine value 180, EPA content 18%, through the process of first subjecting it to the first winterization at −1° C. for 16 hours to effect dewaxing, then subjecting it to the second winterization at −7° C. for 12 hours to effect finish-dewaxing. The yield of the winter oil was 65% relative to 100 parts of the fish oil, the starting material.

To 100 parts of the winter oil thus obtained, 5 parts of glycerol and 5 parts of distilled monooleyl glyceride were added, and the mixture was heated with agitation to 50° C., thereby a transparent mixed oil was obtained.

The mixed oil thus obtained was continuously charged into a falling-film type vacuum deodorizing apparatus having vaporization area of 2 $m^2$ for heating process with hot medium, and deodorization was performed under the conditions: the temperature of the charged oil 70°-80° C., degree of vacuum 50-30 mmTorr, film temperature 130°-150° C., and charging rate 210 kg/hr/$m^2$; thereby 104 parts of deodorized oil was obtained relative to 100 parts of the fish oil.

Subsequently, the first distillation was carried out by charging the deodorized oil continuously into a high vacuum falling-film type distilling apparatus of heating process with hot medium, having a vaporization area 2 $m^2$, and under the distillation conditions: the charging oil temperature 150°-170° C., degree of vacuum 7-10 mmTorr, film temperature 220°-230° C., charging rate 110 kg/hr/$m^2$, thereby 95 parts of remnant oil was obtained. Then the remnant oil was continuously charged into a heating type centrifugal molecular distillation apparatus, and the second distillation was performed under the distillation conditions: the charging oil temperature 170°-180° C., degree of vacuum 3-5 mmTorr, charging rate 50 kg/hr/$m^2$, thereby 60 parts of remnant oil was obtained. Said remnant oil was further charged into a centrifugal molecular distillation apparatus of heating process with hot medium, having vaporization area of 1 $m^2$, and the third distillation was effected under the distillation conditions of charging oil temperature 200°-210° C., degree of vacuum 3-5 mmTorr, film temperature 280°-290° C., and charging rate 30 kg/hr/$m^2$, and the volatilized substances were collected as the refined oil. As the result 35 parts refined fish oil was obtained relative to 100 parts of the fish oil, the starting material.

The properties of the thus obtained refined fish oil were just as given in the following Table 1.

TABLE 1

| (Properties of Refined Fish Oil) | |
|---|---|
| Acid value | 0.01 |
| Iodine value | 215 |
| POV | 0.4 |
| Content of Glyceride | 98.0% |
| Content of Cholesterol | 0.07% |
| Percentage of EPA in Fatty Acids | 25.5% |
| Content of Amines | not detectable |
| Content of Ketones | not detectable |

EXAMPLE 2

Using sardine oil as the starting material having acid value 22, saponification value 192, iodine value 178, and C.P. 11° C., deacidification and decoloration procedures in the usual manner were performed to give a pre-refined sardine oil having acid value 0.15 and moisture content 0.1%.

To 100 parts by weight of the pre-refined sardine oil thus obtained, 0.2 parts by weight of sodium methylate was added, and the interesterification reaction was effected with stirring under nitrogen gas at a temperature of 20°-22° C. for 12 hours. After confirming the cloud point as 20° C., phosphoric acid in an amount corresponding to neutralization equivalent was added to neutralize the reacted substances. 95% by weight of interesterified oil having acid value 1.2, saponification value 192, iodine value 177.8 and cloud point 20° C. was obtained.

To 100 parts by weight of the interesterified oil, 3 parts by weight of dipropylene glycol and 2 parts by weight of distillated monooleyl glyceride were added, the mixture was heated with stirring to 40° C., thereby a transparent mixed oil was obtained.

The mixed oil thus obtained was continuously charged into a falling-film type vacuum deodorizing apparatus of heating process, with hot medium, having vaporization area of 2 $m^2$, and deodorization was performed under the conditions: the temperature of the charged oil 38°-43° C., degree of vacuum 50-55 mmTorr, film temperature 65°-75° C., and charging rate 130 kg/hr/$m^2$, thereby 100.7 parts by weight of deodorized oil was obtained.

Subsequently, the deodorized oil thus obtained was continuously charged into a falling-film type high vacuum distillation apparatus of heating process with hot medium, having vaporization area of 2 $m^2$, and the first distillation was carried out under the conditions: the temperature of the charged oil 120°-125° C., degree of vacuum 15-20 mmTorr, film temperature 240°-250° C., and charging rate 125 kg/hr/$m^2$, thereby 93.3 parts by weight of remnant oil was obtained. The remnant oil was continuously charged into a centrifugal molecular distillation apparatus of heating process, having vaporization area of 1 $m^2$, and the second distillation was carried out under the conditions: the temperature of the charged oil 200°-210° C., degree of vacuum 9-11 mmTorr, and charging rate 50 kg/hr/$m^2$, thereby 50.1 parts by weight of remnant oil was obtained. Further, the remnant oil thus obtained was continuously charged into a centrifugal molecular distillation apparatus of heating process with hot medium, having vaporization area of 1 $m^2$, and the third distillation was performed under the conditions: the charging oil temperature 230°-235° C., degree of vacuum 8-9 mmTorr, film temperature 260°-265° C., charging rate 35 kg/hr/$m^2$, and the vaporized substances as refined oil were coagulated, thereby 31.4 parts by weight of refined fish oil was obtained.

The properties of the thus obtained refined fish oil were as given in Table 2.

TABLE 2

| (Properties of Refined Fish Oil) | |
|---|---|
| Acid value | 0.10 |
| Content of Cholesterol | 0.06% |
| Content of Triglyceride | 96.98% |
| Content of Monoglyceride | 0.54% |
| Content of Diglyceride | 0.62% |
| Content of Fatty Acids | 0.50% |
| Percentage of EPA in Fatty Acids | 18.7% |
| Percentage of DHA in Fatty Acids | 15.9% |
| Content of Amines | not detectable |
| Content of Ketones | not detectable |

EXAMPLE OF TESTING 1

The refined fish oil obtained according to the above Example was used as the test sample and a refined fish oil obtained separately by deacidification, decoloration and deodorization by use of a crude sardine oil according to a conventional method was used as the comparative sample. To the respective samples, 0.1% alpha-tocopherol was added as the antioxidant, and subsequently each 98 g of these samples was filled in a bottle of the capacity 100 ml and subjected to nigrogen gas-sealing, then stored at normal temperature (20° C.), and thus the fishy odor-emitting state was observed. The results were as given in the following Table 3.

TABLE 3

| | (Fishy Odor-Emitting State) | | | |
|---|---|---|---|---|
| | Right after production | After a month | After 2 months | After 3 months |
| Test sample | completely odorless | completely odorless | completely odorless | slight odor emission |
| Comparative sample | slight odor emission | emission of badly fishy odor | emission of badly fishy odor | emission of badly fishy odor |

EXAMPLE OF TESTING 2

The refined fish oil obtained in Example 2 was used as the test sample and a refined fish oil obtained separately by deacidification, decoloration and deodorization by use of a crude sardine oil according to a conventional method was used as the comparative sample. To the respective samples, 0.1% by weight of alphatocopherol was added, and subsequently each 98 g of these samples was filled in a bottle of the capacity 100 ml, subjected to sealing, stored at normal temperature (20° C.), and thus the fishy odor-emitting state was observed. The results were as given in Table 4.

TABLE 4

| | (Fishy Odor-Emitting State) | | | |
|---|---|---|---|---|
| | Right after production | After a month | After 3 months | After 6 months |
| Test sample | completely odorless | completely odorless | completely odorless | slight odor emission |
| Comparative sample | slight odor emission | emission of badly fishy odor | emission of badly fishy odor | emission of badly fishy odor |

I claim:

1. A process for producing refined fish oil, which comprises subjecting a mixture of a polyhydric alcohol, a monoglyceride and a fish oil to a preliminary molecular distillation to remove volatile components and deodorize the fish oil, subjecting the deodorized fish oil thus obtained to further molecular distillation and recovering the vaporized constituents as the refined fish oil.

2. A process for producing a refined fish oil, which comprises subjecting a mixture of a polyhydric alcohol, a monoglyceride and an interesterified fish oil to a preliminary molecular distillation to remove volatile components and deodorize the fish oil, subjecting the deodorized fish oil thus obtained to further molecular distillation and recovering the vaporized constituents as the refined fish oil.

3. A process for producing a refined fish oil, which comprises subjecting a mixture of a polyhydric alcohol, a monoglyceride and a winterized fish oil to a preliminary molecular distillation to remove volatile components and deodorize the fish oil, subjecting the deodorized fish oil thus obtained to further molecular distillation and recovering the vaporized constituents as the refined fish oil.

4. A process according to claim 1, wherein the deodorized fish oil is subjected to a three-stage molecular distillation in which the deodorized fish oil is subjected to a first distillation at a film temperature of 100°-260° C. and under a vacuum of 5-30 mm Torr, the residue obtained from said first distillation is subjected to a second distillation at a film temperature of 150°-300° C. and under a vacuum of 0.1-50 mm Torr, and the residue obtained from the second distillation is subjected to a third distillation at a film temperature of 200°-300° C. and under a vacuum of 0.1-30 mm Torr.

5. A process according to claim 2, wherein the deodorized fish oil is subjected to a three-stage molecular distillation in which the deodorized fish oil is subjected to a first distillation at a film temperature of 100°-260° C. and under a vacuum of 5-30 mm Torr, the residue obtained from said first distillation is subjected to a second distillation at a film temperature of 150°-300° C. and under a vacuum of 0.1-50 mm Torr, and the residue obtained from the second distillation is subjected to a third distillation at a film temperature of 200°-300° C. and under a vacuum of 0.1-30 mm Torr.

6. A process according to claim 3, wherein the deodorized fish oil is subjected to a three-stage molecular distillation in which the deodorized fish oil is subjected to a first distillation at a film temperature of 100°-260° C. and under a vacuum of 5-30 mm Torr, the residue obtained from said first distillation is subjected to a second distillation at a film temperature of 150°-300° C. and under a vacuum of 0.1-50 mm Torr, and the residue obtained from the second distillation is subjected to a third distillation at a film temperature of 200°-300° C. and under a vacuum of 0.1-30 mm Torr.

7. A process according to claim 3, wherein winterization is performed in two stages: the first winterization of fish oil at from 5° to −2° C., then the second winterization at from −2° to −10° C.

8. A process according to claim 7, wherein the deodorized fish oil is subjected to a three-stage molecular distillation in which the deodorized fish oil is subjected to a first distillation at a film temperature of 100°-260° C. and under a vacuum of 5-30 mm Torr, the residue obtained from said first distillation is subjected to a second distillation at a film temperature of 150°-300° C.

and under a vacuum of 0.1–50 mm Torr, and the residue obtained from the second distillation is subjected to a third distillation at a film temperature of 200°–300° C. and under a vacuum of 0.1–30 mm Torr.

9. A process according to claim 1, wherein said preliminary molecular distillation is at a temperature of 90°–150° C. and under a vacuum of 10–100 mm Torr.

10. A process according to claim 2, wherein said preliminary molecular distillation is at a temperature of 90°–150° C. and under a vacuum of 10–100 mm Torr.

11. A process according to claim 3, wherein said preliminary molecular distillation is at a temperature of 90°–150° C. and under a vacuum of 10–100 mm Torr.

12. A process according to claim 4, wherein said preliminary molecular distillation is at a temperature of 90°–150° C. and under a vacuum of 10–100 mm Torr.

* * * * *